United States Patent [19]

Blawn et al.

[11] 4,036,495

[45] July 19, 1977

[54] TIME DELAY MECHANISM FOR AUTOMATIC PINSETTING MACHINE

[76] Inventors: Thomas A. Blawn, 1898 Islip Ave., Central Islip, N.Y. 11722; James F. Blawn, 190 Victory Drive, Lake Ronkonkoma, N.Y. 11779

[21] Appl. No.: 695,769

[22] Filed: June 14, 1976

[51] Int. Cl.[2] ..... A63D 5/00

[52] U.S. Cl. ..... 273/43 R

[58] Field of Search ..... 273/43 R, 43 A, 54 R

[56] References Cited

U.S. PATENT DOCUMENTS

| | | | |
|---|---|---|---|
| 3,514,104 | 5/1970 | Perricone | 273/43 R |
| 3,790,167 | 2/1974 | Lenhart et al. | 273/43 R |

*Primary Examiner*—Anton O. Oechsle
*Attorney, Agent, or Firm*—Kirschstein, Kirschstein, Ottinger & Frank

[57] ABSTRACT

The essence of the invention resides in the positioning of a micro-switch on a cushion rod or its equivalent which reacts to the impact of a bowled ball against the cushion even when the ball impacts against the cushion very lightly. The light impact urges the closing of contacts in the micro-switch to energize a control circuit which commences the operation of a time delay means via a switch circuit so that a three second time delay is positively initiated before the cycling of the pinsetting machine takes place. The three second time delay occurs through an RC time constant in a electronic circuit and continues uninterrupted even if the bowled ball vibrates against the cushion. In a previously mechanically operated time delay within the pinsetting machine, the alternative embodiment uses its own electronic time delay circuitry with a switch circuit therein which is activated by the aforementioned micro-switch to reduce the necessity of utilizing a reset button and insuring the positive cycling of the pinsetter in proper sequence.

7 Claims, 12 Drawing Figures

FIG. 2
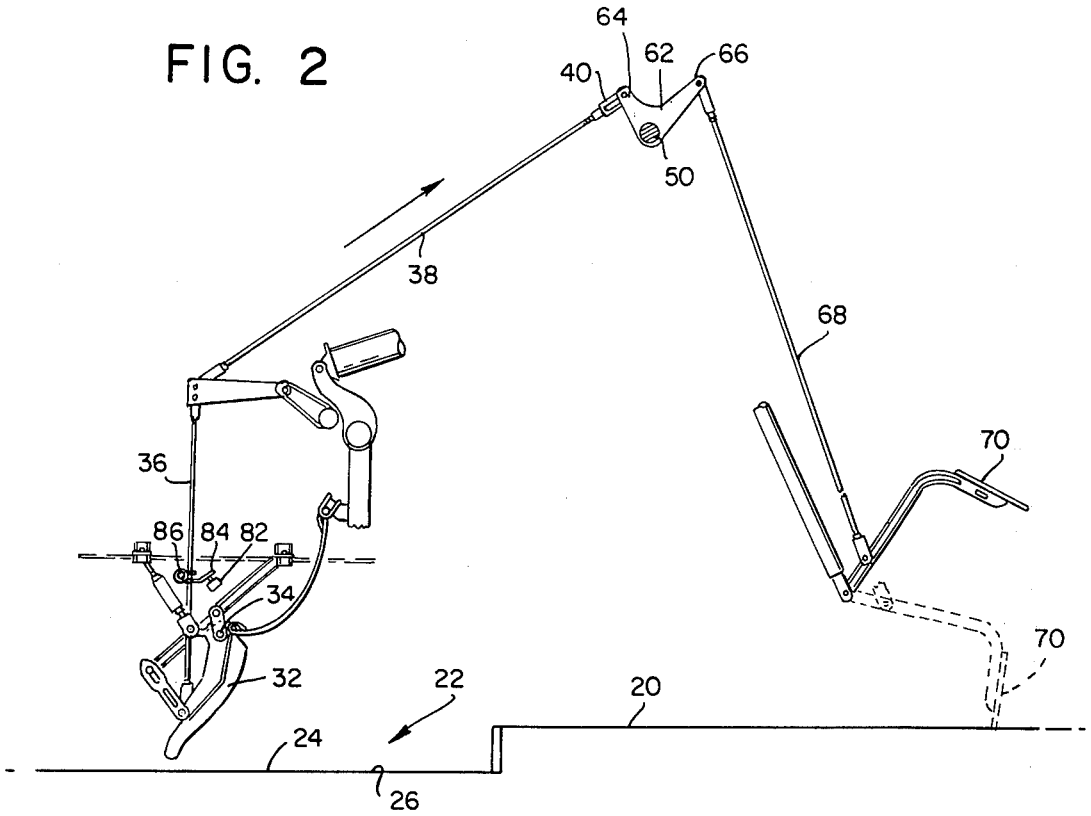
FIG. 6
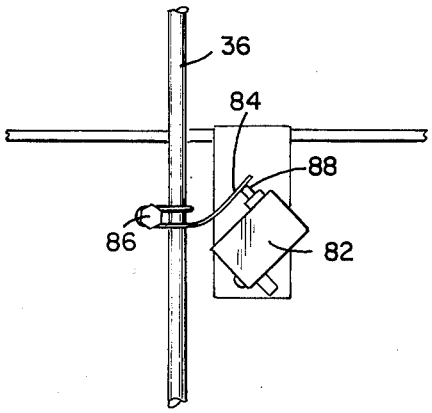
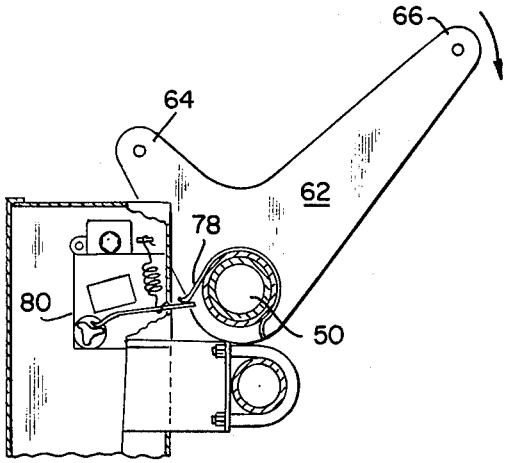
FIG. 3

FIG. 4
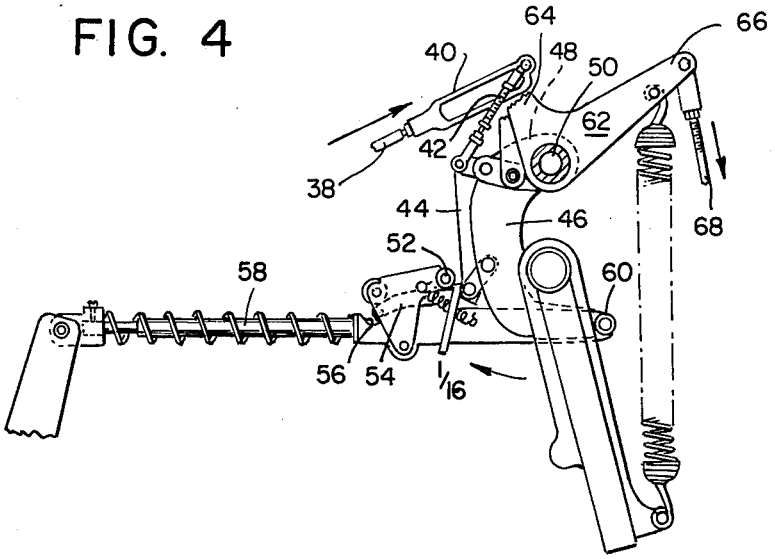
FIG. 12
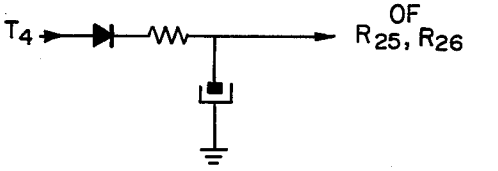
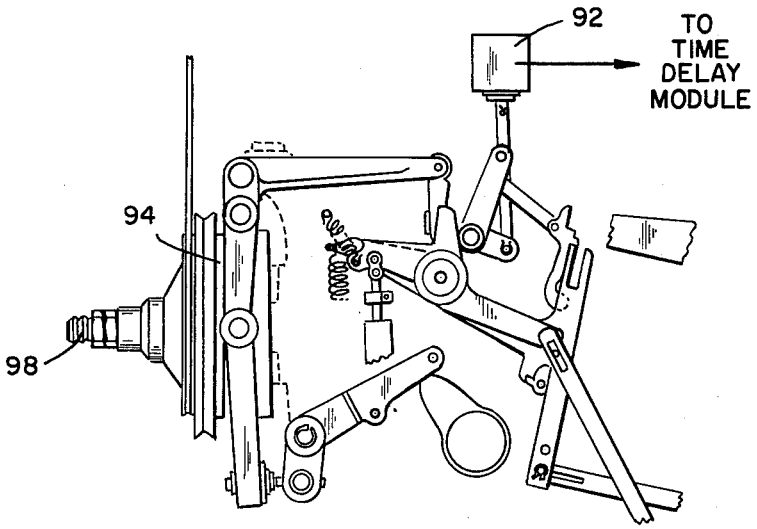
FIG. 5

TIME DELAY MECHANISM FOR AUTOMATIC PINSETTING MACHINE

BACKGROUND OF THE INVENTION

1. Field of the Invention

The present invention relates to a switching arrangement and circuit therefor to be used in an automatic pinsetter to provide for the positive activation of the machinery in the instance of a weakly bowled ball.

2. Description of the Prior Art

Heretofore the Brunswick automatic pinsetters, both fully mechanical and partially electronic, have had difficulty in going through their normal operation when a weakly bowled ball is rolled by the bowler. This problem arose generally when children bowled, and requied the constant use of the "reset" button at or near the scoring table.

When a lightly rolled ball was bowled, it would strike the cushion at the rear of the well at the end of the alley with insufficient force to trigger the cycling of the machinery.

In the Brunswick machines, in order to actuate the trigger switch the bowled ball must strike the cushion at the back of the well with sufficient force to pivot the cushion. This movement would cause the cushion rod to rise which in turn through the various linkages cause the rake to come down thereafter actuating a trigger clip (in the partially electronic machinery) and thereby closing the trigger switch. If there was any "slop" or "play" in the linkages, a soft impact or weak movement of the cushion would not be sufficient to actuate the triggering mechanism.

Sometimes the ball would be caused to vibrate against the cushion by the vibration of the carpet causing the contact of ball to cushion to be intermittent thereby interrupting the operation and thereby requiring the pressing of the "reset" button by the bowler. This intermittent operation arose because the agitated carpet in the well made the bowling ball contact the cushion intermittently by its agitated movement without sufficient force on the cushion to cause the lifting of the cushion rod to activate the rake and thereby cause the rake spring clip to turn and close the contacts of the switch to operate the time delay module. In the cases of the purely mechanical and partially electric pinsetter, the time delay would not operate properly thereby requiring the use of the reset mechanism of the machine.

The improper operation of the machine caused delay and in many instances, provoked added maintenance, time and costs to the point where major losses in revenue were occasioned. Many attempts have been made to remedy this problem but none have been successful.

It is toward the elimination of these as well as other problems that this invention is directed.

SUMMARY OF THE INVENTION

Purpose of the Invention

It is an object of the present invention to provide a more sensitive switching arrangement for the Brunswick pinsetter so that a light striking ball will trigger the cycling thereof.

Another object of the present invention is to decrease the malfunctioning of the pinsetting equipment by positively actuating the time delay module in the pinsetter.

Still another object of the present invention is to provide circuitry which will positively trigger the time delay means even if a lightly thrown ball very softly strikes the cushion.

Yet another object of the present invention is to provide a switching arrangement and circuit therefor which will permit the continued operation once the bowled ball strikes the cushion and will not be interrupted if the ball continues to intermittently strike the cushion.

A further object of the present invention is to permit the pinsetting machine to cycle with only the slightest of impact by a bowled ball against the cushion.

Another object of the present invention is to avoid the constant necessity of readjusting the rods which join the rear cushion to the trigger switch to maintain the highest optimum sensitivity to impact.

Still another object of the present invention is to provide an adjunct to presently existing machines which will not require the complete overhauling and modification of the machines in existence.

Yet another object of the present invention is to eliminate for all practical purposes the use of the reset buttons.

Yet a further object of the present invention is to eliminate customer initiated malfunctions of the cycling system.

Still a further object of the pesent invention is to permit a faster and more efficient use of the pinsetting equipment to increase the amount of working time of each automatic pinsetter.

A further object of the present invention is to provide a circuit arrangement which will positively trigger a delay mechanism for the proper operation of a cycling device.

In an alternative embodiment of the present invention, it is an object of the present invention to replace the mechanical time delay means and substitute circuitry which will be more sensitive to the impact of a softly bowled ball to insure the proper cycling of the pinsetting machine.

Brief Description of the Invention

Generally, the foregoing and other objects of the present invention, which will become more apparent as the description of the invention proceeds are achieved by providing a normally opened microswitch adjacent the cushion lift rod whereby the slight impact of a bowled ball against the cushion will permit the closing of the switch thereby activating a switching and control circuit which in turn will trigger a time delay arrangment in the pinsetter so that its operation, once commenced, will not be interrupted culminating in the proper sequential cycling and operation of the automatic pinsetting machinery.

BRIEF DESCRIPTION OF THE INVENTION

For a better understanding of the present invention reference should be had to the accompnaying drawings wherein like numerals of reference indicate similar parts throughout the respective views and wherein:

FIG. 2 is a pictorial representation of certain linkages of the pit cushion lift rod to the rake;

FIG. 3 is a pictorial representation of the pit cushion trigger switch arrangement;

FIG. 4 is a pictorial representation of the components which aid in the operation of the rake;

FIG. 5 is a partial representation of the clutch mechanism;

FIG. 6 is a pictorial representation of the pit cushion lift rod showing the position of the micro-switch;

FIG. 12 is a schematic diagram of a circuit used in the second ball circuit to negate the time delay of FIG. 11.

BRIEF DESCRIPTION OF BRUNSWICK AUTOMATIC PINSETTER OPERATION

Before describing in detail the improvements provided by the present invention, it will be necessary to described generally the mechanical operation in part of the Brunswick automatic pinsetter for the present invention utilizes and does not alter the mechanics of that machine but merely compliments the existing machine's mechanical and electrical operation. In fact, the present invention may be installed in the existing Brunswick automatic pinsetting machines in a relatively short period of time without any major alteration of the existing equipment. In the case of the wholly mechanical Brunswick automatic pinsetter, there is proposed in one alternative embodiment of the present invention to replace the mechanical time delay unit with an electronic time delay module to increase the overall efficiency of that purely mechanically operated machine and to further reduce any chances of its malfunction.

Figure 1:
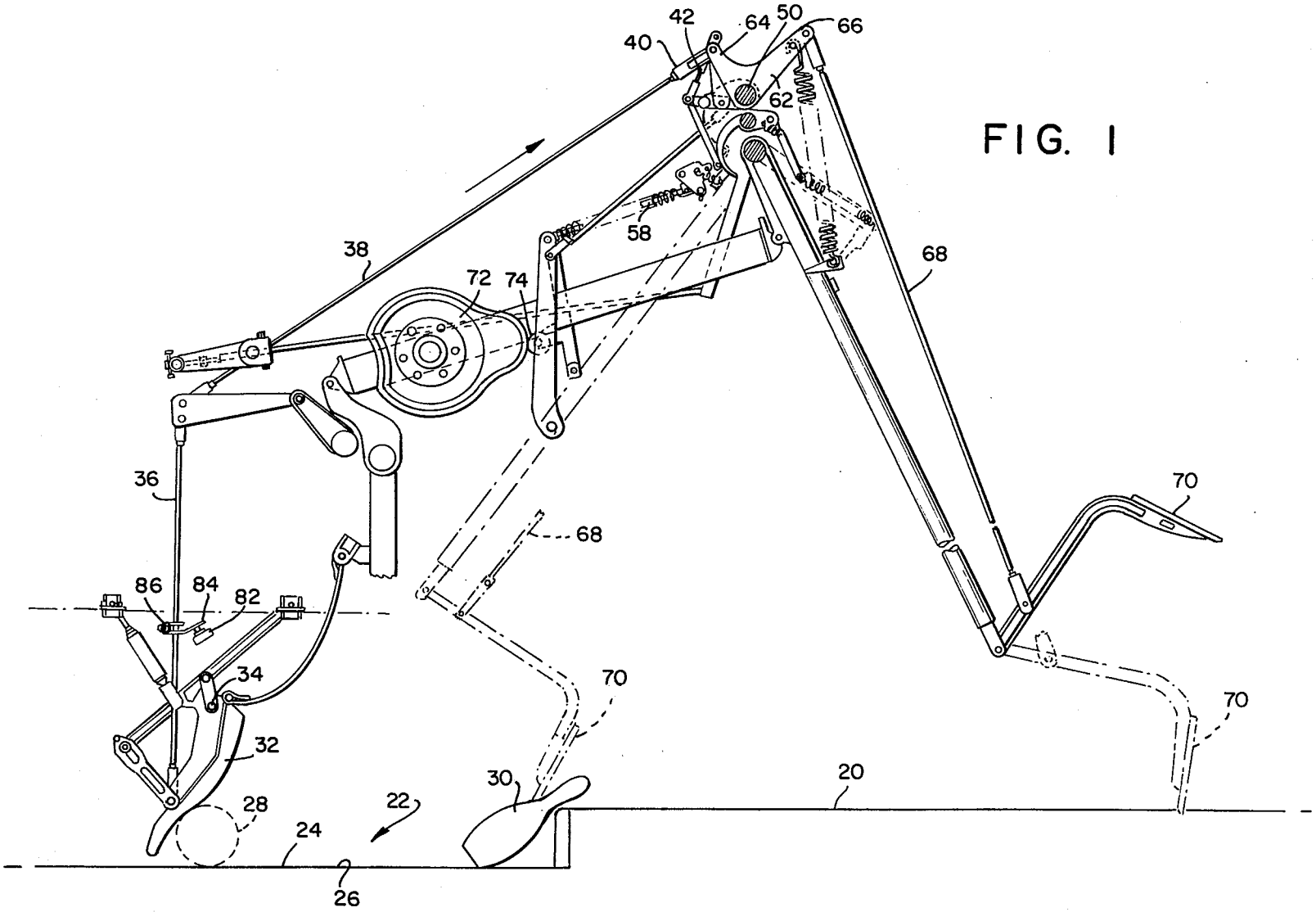
FIG. 1 is a pictorial representation of the apparatus used to operate the rake sweep arm of the automatic pinsetter.

As shown in FIG. 1, at the end of a bowling lane 20, there is provided a well 22 at the bottom 24 of which is an agitated carpet 26. The bowling ball 28 after being bowled strikes the pins 30 and proceeds into the well. In the case of a regularly thrown ball, the bowling ball 28 will strike the cushion 32 at the rear end of the well 22 and impact thereaginst. The impact of the ball 28 against the cushion 32 will cause the cushion 32 to move rearwardly and pivot about the pivot point 34 thereby causing the cushion rod 36 to move upwardly. All impacts of the ball 28 to cushion 32 will cause the upward movement of the cushion rod 36 which will in turn cause the rod 38 to move in the direction of the arrow. If the impact is too soft the cushion rods movement will be insufficient to activate the cycling mechanism. However, in the prior art machine if the impact is sufficient, the top end 40 of the rod 38 thereafter moves slightly causing the trigger link turnbuckle 42 to move upwardly. The rake trip level 44, since its upper end is connected to the trigger link turnbuckle 42, moves upwardly and rearwardly thereby causing the rake trip lever 44 to contact the rake trip roller 52 forcing the release lever 54 to disengage from a recess 56 in the shotgun 58. The disengagement of the release lever 54 from the recess 56 causes the shotgun 58 to collapse. The collapse of the shotgun 58, one end of which is fixedly connected to the lower end 60 of "C" lever 46, causes the lower end 60 of the C-lever to be forcibly pulled rearwardly causing the C-lever 46 to pivot about the shaft 50, in the direction of the arrow shown in FIG. 4. A bell crank lever 62 is fixedly mounted on the shaft 50 having its rearward arm 64 connected to the top end 40 of the rod 38 and its forward arm 66 connected to the rake sweep arm 68 which after a three second time delay will move the rake 70 rearwardly to clear the lane 20 of fallen pins 28. It should be noted that the rake 70 comes down across the lane 20 first and after the three second time delay, the machine will operate sequentially which includes the actuation of the rake sweep arm 68 to sweep the lane 20 clear of fallen pins.

A three second time delay in operation of the rake sweep arm 68 is necessary to permit wobbling pins or falling pins to achieve a stationary position so that a deck (not shown) can come down and lift the stable standing pins 30 so that the rake 70 can sweep the lane 20 clear.

Figure 7:
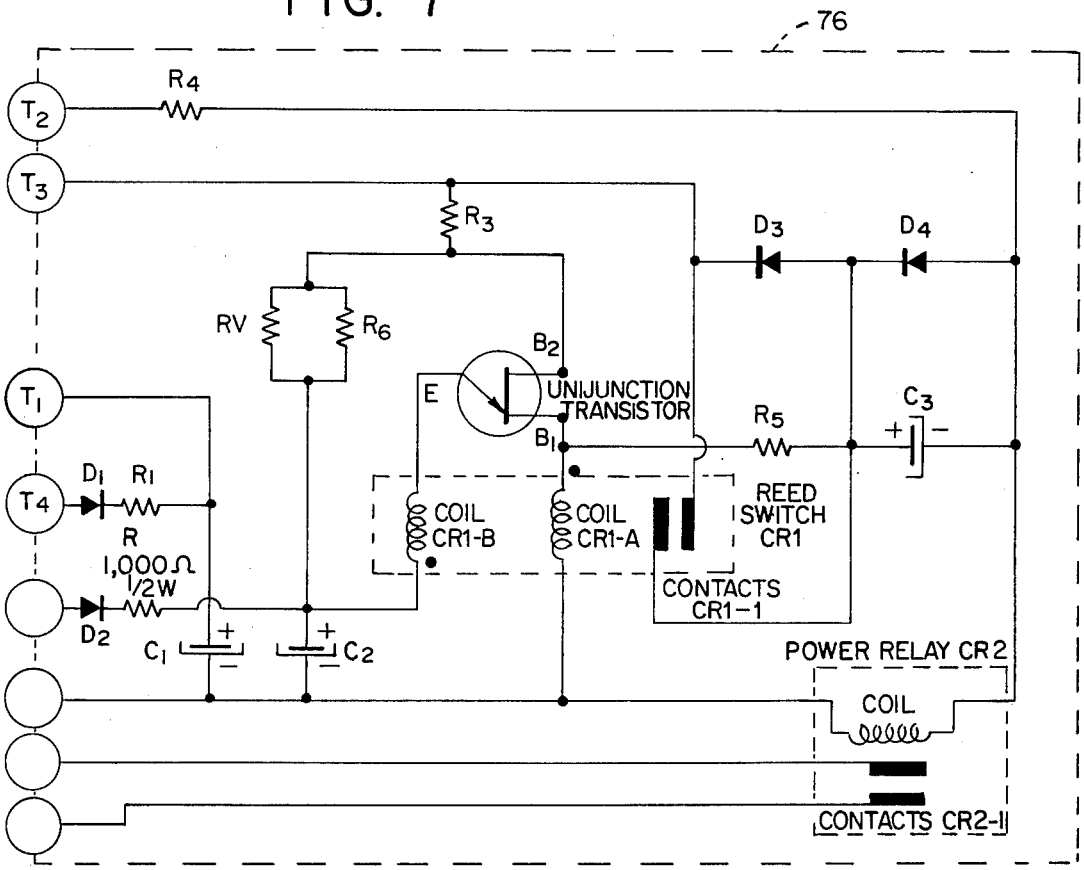
FIG. 7 is a schematic diagram of the time delay module.

In this operation of the automatic pinsetting device, the three second pulse time delay is provided via the operation of the time delay module 76, a schematic diagram of which is shown in FIG. 7. The time delay module 76 controls the operation of a solenoid and gear box (partially shown in FIG. 5) which in turn controls the operation of the cam 72 and cam follower 74.

In this operation of the pinsetter, the prior art activating of the time delay module 76 is caused by, as shown in FIG. 3, the rotative motion of the shaft 50 which causes a triggering clip 78 to urge the contacts of the trigger switch 80 to close applying a B+ voltage from terminal $T_1$ to terminal $T_3$ of the time delay module 76 such that the capacitor $C_2$ therein with resistors $R_v$ and $R_6$ have an RC time constant of 3 seconds.

Once the three second time period of the delay has elapsed, the unijunction transistor in the time delay module (see FIG. 7) conducts, energizing CR-1, closing its contacts, capacitor $C_3$ will then attempt to charge. The charging action of $C_3$ will energize the power relay CR-2 closing its contacts thereby energizing the solenoid 92 to which it is connected. The solenoid 92 shown in FIG. 5 when closed permits the cycling of the machinery so that the rake 70 sweeps the lane 20 and the continued operation of cam 72 and cam follower 74 resets the shotgun 58 for the next cycle.

At the commencement of the three second time delay and during the three second charge time of $C_2$, the trigger switch 80 must remain closed or the charging of the capacitor $C_2$ will be interrupted. Herein lies one of the major problems with the prior art machinery to which the invention hereinafter described is, in part, directed as well as those problems previously set forth.

BRIEF DESCRIPTION OF THE PREFERRED EMBODIMENT

In order to provide for the positive actuation of the time delay module 76 there is provided a micro-switch 82 which is mounted adjacent to the cushion rod 36. An actuator lever 84 is adjustably connected to cushion rod 36 by means of a screw adjustment 86 which permits the adjustment of positioning of actuator lever 84 along the cushion rod 36. The micro-switch 82 is normally open when the actuator lever 84 is urged against the switch button 88. It should be noted that the actuator lever 84 is bent at a particular angle with respect to the cushion 32 and cushion rod 36 so that if there is forward or rearward movement of the cushion 32 as by being struck by a bowling pin, the actuator lever 84 would remain in contacting position against the switch button 88 holding the micro-switch in its open position thereby preventing a false cycling of the machine.

It should be further noted that the micro-switch may be located anywhere adjacent the cushion rod 36 but for ease of installation and access, it is preferred that the micro-switch 82 be mounted on kickback plate 90 (shown in part in FIG. 6).

When the actuator lever 84 is moved only slightly so that its pressure is relieved from the switch button 88, the micro-switch 82 will close and thereby will permit the application of B+voltage through the hereinafter described circuitry to terminal $T_3$ of the time delay module 76. In the prior art Brunswick system, the cushion 32 must be lifted sufficiently in order for the machine to cycle. If the cushion is not lifted sufficiently, the machine will not operate or cycle, as previously described, and the customer must push the reset button 96 (not here shown) in oder to start the cycle. However, with the application of the invention as heretofore and hereafter described, the pinsetter will cycle when the ball strikes the cushion 32 with only a small force requiring a small fraction of the lift of the cushion previously required to cycle the prior art machinery. All that need take place is upon the balls impact with the cushion, is a split second of lifting of the actuatory lever 84 from the switch button 88, thereby closing the micro-switch 82.

Figure 8:
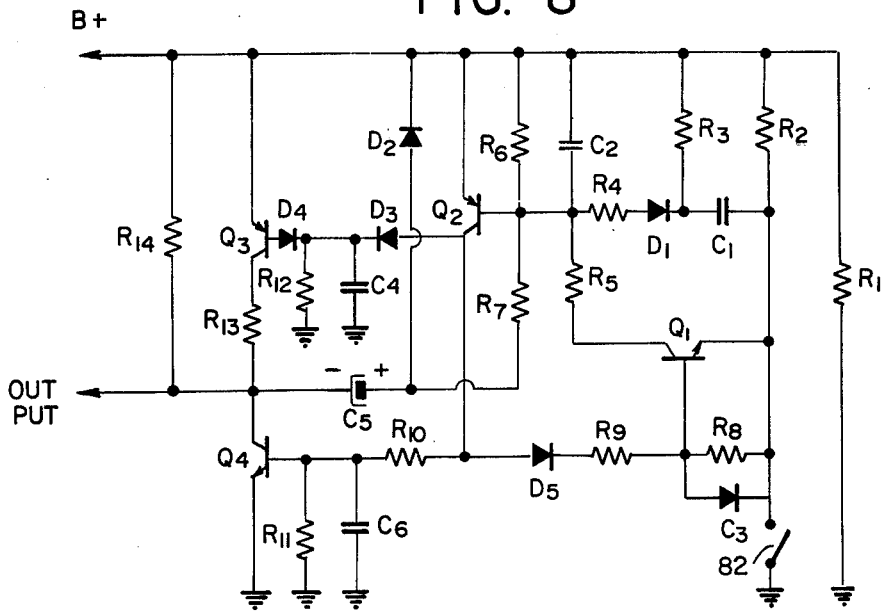
FIG. 8 is a schematic diagram of the control circuit.
Figure 9:
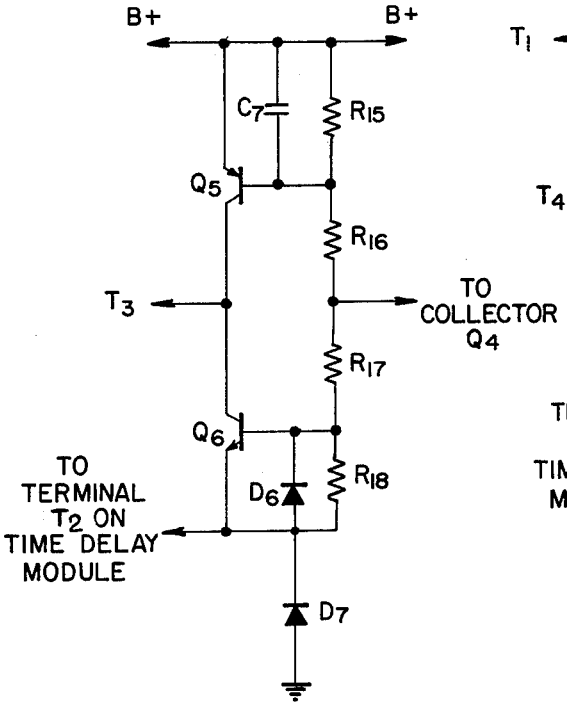
FIG. 9 is a schematic diagram of the switch circuit.

Referring now to the schematic drawings of FIGS. 8 and 9, FIG. 8 represents a control circuit and is connected to the micro-switch 82. The purpose of the control circuit briefly stated, is that once the contacts in the micro-switch 82 close, the control circuit, which in very general terms, is a monostable multivibrator with a hold at transistor $Q_1$, will provide a continuous uninterrupted signal. The switching circuit shown in FIG. 9, in essence, replaces the triggering switch 80 and itself acts as a switch. The operation of both circuits will hereinafter be described in detail.

B+ is at terminal $T_1$ of the time delay module 76, which electrical construction remains the same as used in the prior art Brunswick machines. Referring to FIG. 8, transistors $Q_1$, $Q_2$ and $Q_4$ are "off" and all capacitors are at B+ potential. $Q_3$ is turned "on" through its emittor base, $D_4$ and $R_{12}$ to ground. When the micro-switch 82 is closed, as by slightest movement of the actuator lever 84, capacitor $C_1$, will charge through the emittor base junction of $Q_2$, $R_4$, forward biased diode $D_1$ and switch 82 to ground, turning on transistor $Q_2$. With $Q_2$ on, B+ is applied to its collector and the junction of diode $D_3$, $R_{10}$ and $D_5$. This in turn will turn off $Q_3$ by making the junction of $D_4$ and $R_{12}$ approximately 0.6 volts more positive than it previously was by means of $D_3$ and at the same time, turning on $Q_4$ through $Q_4$'s emittor base junction and $R_{10}$ to B+. At the time $Q_4$ turns on, $Q_4$'s collector is turned to ground potential. This condition will allow capacitor $C_5$ to charge from ground potential through $R_7$ and the emittor base junction of $Q_2$.

It is important to note that if the micro-switch 82 were to open, as by the actuator lever 84 coming back into contact with the switch button 88, in rapid succession, because the bowling ball 28 is being agitated against the cushion 32 by the carpet 26, $Q_2$ and $Q_4$ would remain in the on condition due to the relatively slow charging time of capacitor $C_5$. The charging rate of $C_5$ is greater than the three second time lag of the time delay module 76 to insure that the pinsetting machine will cycle. Once the machine started to cycle, the micro-switch 82 would close completely if it had not already done so by a ball 28 thrown hard enough to release the rake mechanism, since the micro-switch 82 is tied into the rake mechanism. Transistor $Q_1$ holds $Q_2$ and $Q_4$ on after the pinsetting machine has cycled through the completely closed contacts in FIG. 8 of the micro-switch 82, even though capacitor $C_5$ has fully charged. $Q_1$ is turned on by the B+ appearing at the junction of diodes $D_5$, $D_3$ and resistor $R_{10}$ through diode $D_5$, resistor $R_9$, $Q_1$'s emittor base junction and micro-switch 82 to ground. The collector of $Q_1$ is now at ground potential, and the circuit is held on through the emittor base junction of $Q_2$, which is already on, $R_5$, $Q_1$ and micro-swich 82 to ground.

The above-detailed description relates to the on cycle of the control circuit shown in FIG. 8, and the following description of the control circuit operation takes places as the circuit shuts off to get ready for the next cycle.

The micro-switch 82 is opened as the cushion 32 comes to its rest position, shown in the solid line drawing of FIG. 1. The ground potential at the emittor of $Q_1$ is lost because micro-switch 82 is opened and $Q_1$ releases allowing $Q_2$ to release because the ground is missing from resistor $R_5$, which will allow $Q_4$ to release because of a loss of B+ at the junction of $R_{10}$, $D_5$ and $D_3$. $Q_3$ will turn on because the junction of $D_3$, $D_4$ and $R_{12}$ is allowed to go approximately 0.6 of a volt more negative since B+ from $D_3$ is not present. Capacitor $C_5$ will discharge through the turned on $Q_3$ and diode $D_2$ almost instantaneously to B+ setting up for the next cycle. The reversed biased diode $D_1$, when microswitch 82 is opened, will allow $C_1$ to discharge through $R_2$ and $R_3$ to B+, with a slight time lag in the event the machine has "play" in the cushion and micro-switch 82 is opened and closed with a bounce to it is allowed to open completely as the cushion 32 comes to a full rest position. $R_{13}$ is for the transistor protection between $Q_3$ and $Q_4$.

The above-described circuit operations fully disclose the operation of the control circuit in its on and turn off conditions. This control circuit of FIG. 8 is used on all the Brunswick automatic pinsetting machines as part of their modification in accordance with the present invention. On the Brunswick machines containing the time delay module 76, or models A-1½or A-2, the above-described control circuit must work in conjunction with the switching circuit shown in FIG. 9. As previously indicated, the switching circuit acts as a switch and in effect, replaces the old trigger switch 80. As will become apparent to those skilled in the art, the control circuit and switching circuit cooperate to permit the original time delay module 76 shown in FIG. 7 to operate for its originally intended purpose. B+ coming from terminal $T_1$ on the time delay module 76 is applied. The junction of $R_{16}$ and $R_{17}$ must connect to the collector of $Q_4$ in the control circuit of FIG. 8 and $Q_5$ is off. $Q_6$ being turned on, puts its collector at its emittor's potential, which holds terminal $T_2$ to terminal $T_3$ on the time delay module 76 and keeps capacitor $C_3$ in the time delay module 76 from charging up. (Note: $C_3$ located in the time delay module, when charging, energizes power relay $CR_2$ also located in the time delay module.) $Q_6$ replaces the normally closed contacts of switch 80 (rake switch) located in the electrical box.

When the control circuit is activated (or turned on), B+ is removed from the junction of $R_{16}$ and $R_{17}$, and ground potential is applied through the collector of the turned on $Q_4$ in the control circuit. With the loss of positive potential at the base of $Q_6$, transistor $Q_6$ will turn off, opening terminal $T_2$ and $T_3$ on the time delay module 76. At the same time, $Q_5$ will turn on.

With $Q_5$ turned on, B+ is applied to its collector and terminal $T_3$ of the time delay module 76. This sets the time delay module 76 in motion. $Q_5$ replaces the normally opened contacts of switch 80 (rake switch) located in the electical box.

When the pinsetting machine comes to its rest position, the control circuit turns off, which will turn off $Q_5$ and turn on $Q_6$ allowing capacitor $C_3$ in the time delay module 76 to discharge negatively at terminal $T_2$ to positive at terminal $T_{23}$ instantaneously. Diode $D_7$ will only permit six tenths of a volt negative spike to appear, as $C_3$ in the time delay module 76 discharges.

Mechanically, the sequence of operation changes somewhat from that previously described operation of the prior art Brunswick pinsetter. When the bowled ball 28 touches the cushion 32 with a small force insufficient enough to release the mechanical trigger linkage but with enough force to lift slightly the cushion thereby closing the microswitch 82, the control circuit, switching circuit and time delay module 76 perform their aforedescribed operation. Energizing the solenoid 92 which causes the engagement of the clutch mechanism 94 which in turn starting the shaft 96 to turn, turning the shaft which is journalled to the cam 72. As the cam 72 turns, the cam follower 74 moves to the low dwell position causing the shotgun 58 to pull back thereby pulling the lower end 60 of the C-lever 46 and causing the same to rotate rearwardly about the shaft 50. The rearward rotation of the C-lever 46 causes the rake 70 to be lowered into its guard position across the lane 20. The sweeping of the lane 20 then takes place in accordance with the sequential operation of the machine.

The continued rotation of the cam 72 moves the cam follower 74 to the high dwell position and resets the shotgun 58 and C-lever 46 to move back to their normal rest positions.

It may be seen that both the control circuit and triggering circuit operate the time delay module 76 to insure application of the three second time delay before the mechanical linkages that control the rake sweep arm 68 commence the operation just described.

It should be noted that on the Brunswick automatic pinsetter machine models A-1½ and A-2, the cycle or reset button (not shown), is connected between B+ (terminal $T_1$ of the time delay module 76) and terminal $T_2$ of the time delay module 76. By depressing the reset button B+ would appear at terminal $T_2$ and would energize the power relay $CR_2$ in the time delay module. If this was done while the control circuit were on, B+ (40 volts) would appear reversed on the emittor base of $Q_6$ which might burn out $Q_6$. Diode $D_6$ will only allow 0.6 volts of a reverse bias to be applied across $Q_6$ in this condition and thereby protect $Q_6$.

Figure 10:
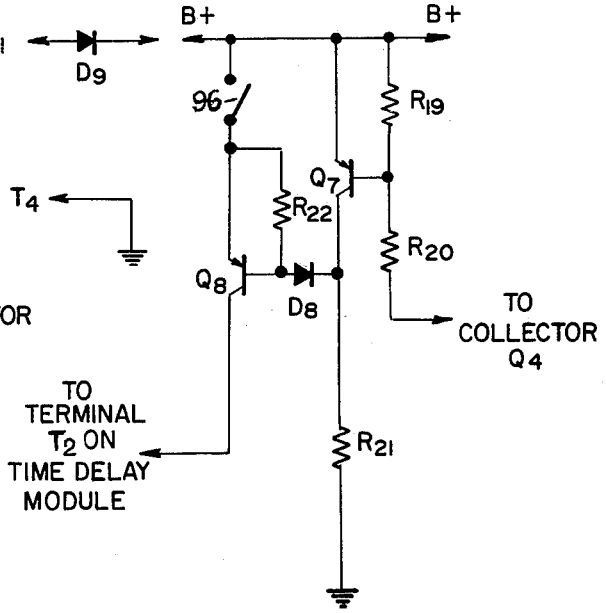
FIG. 10 is a schematic diagram of the cycle button hold circuit.

In order to override the use of the reset button after the control circuit is turned on, there is provided a cycle button hold-out circuit, which includes the reset button 96 (shown in FIG. 10).

Resistor $R_{20}$ of the reset button hold-out circuit is tied to the collector of $Q_4$ in the control circuit which is at B+ potential when the control circuit is off. As a result $Q_7$ is off, and allows $Q_8$ to conduct when 96 (reset button) is depressed. 96 is connected to B+ (terminal $T_1$ on the time delay module), when depressed 96 applies B+ to the emittor base of $Q_8$ forward biased diode $D_8$ and $R_{21}$ to ground. $Q_8$ being turned on, applies B+ to terminal $T_2$ on the time delay module to energize power relay $CR_2$. When the control circuit turns on, $Q_7$ turns on from B+ through its emittor base junction, $R_{20}$ and the collector of $Q_4$ to ground. This will apply 0.6 of a volt more positive to the junction of $D_8$ and $R_{21}$ which will shut off $Q_8$ and any signal coming from the customers reset button on the ball rack. $Q_8$ will be held off until the control circuit turns off, which will turn off $Q_7$. This will remove the B+ at $Q_7$'s collector and allow $Q_8$ to conduct. The reset button hold-out circuit is an optional feature which may or may not be included in all applications of the invention.

It will be seen from the foregoing description of the electrical circuits and their adaptation to the existing mechanics of the Brunswick automatic pinsetter that the objects of providing the time delay module with a positively actuating signal for the faultless operation of the time delay module thereby increasing the efficiency of the automatic pinsetter.

ALTERNATIVE EMBODIMENT

As previously indicated, there is a Brunswick model of and automatic pinsetter which is wholly mechanical. This mechanical model does not have the time delay module of FIG. 7. The modification of this unit is susceptible to the similar positioning of the micro-switch 82 and actuator lever 84 on the cushion rod 36, or its equivalent so that the mechanical modification is the same as previously described. Further, this modification would include the utilization of the control circuit shown in FIG. 8, and the circuit shown in FIG. 11. In essence, the circuit of FIG. 11 takes the place of a time delay module and its function will become readily apparent as the circuit operation is hereinafter described in detail.

The junction of $D_{10}$, $R_{23}$ is connected to the collector of $Q_4$ in the control circuit. All transistors are off and all capacitors are discharged. The control circuit is turned on, capacitor $C_8$ begins to charge up from B+ to ground through $R_{23}$ and the collector of $Q_4$ in the control circuit. $Q_9$ is clamped off by resistors $R_{25}$, $R_{26}$ and $Q_{10}$. $C_8$ must charge down from B+ to a voltage set up by the values of $R_{25}$ and $R_{26}$. Until $C_8$ charges down to this voltage setting, $Q_9$ is held off by a reversed bias emittor base junction. (The voltage point selected equals 3 seconds.) Once capacitor $C_8$ is charged down to this setting, $Q_9$ would turn on, and conduct through turned on $Q_{10}$; $Q_9$'s emittor base $R_{24}$, $R_{23}$ and $Q_4$ to ground. With $Q_9$ turned on, capacitor $C_9$ will charge from emittor base junction of $Q_{11}$, $R_{29}$, $Q_9$ and $Q_{10}$ to B+, turning on $Q_{11}$. With $Q_{11}$ turned on diode $D_{12}$ feels ground potential through the collector of $Q_{11}$ turning on $Q_{11}$ solidly. $Q_{11}$ is turned on, $Q_{12}$ will turn on through $Q_{12}$'s emittor base junction, $R_{32}$ and $Q_{11}$ to ground. With $Q_{12}$ turned on, B+ would be applied to its collector, and capacitor $C_{12}$ will charge through the already turned on emittor base junction of $Q_{11}$ and $R_{33}$ to ground. This will lock $Q_{11}$ and $Q_{12}$ on for a short period of time (the time it would take for $C_{12}$ to fully charge). With $Q_{12}$ turned on, B+ is located at its collector and its voltage divided across $R_{34}$ and $R_{35}$. $Q_{13}$ (which is a triac) has its gate connected to the junction of $R_{34}$ and $R_{35}$, which will turn on $Q_{13}$ as long as $Q_{11}$ and $Q_{12}$ remain on. $Q_{13}$ is connected to the cycle relay which will energize. When capacitor $C_{12}$ is fully charged, $Q_{11}$ and $Q_{12}$ will release and capacitor $C_{12}$ will discharge through $R_{34}$, $R_{35}$ and $D_{13}$ to ground. $Q_{13}$ will release and cycle relay will de-energize. $Q_{11}$, $Q_{12}$ and $C_{12}$ are ready for the next cycle. When the control circuit turns off B+ is applied to the junction of $D_{10}$ and $R_{23}$. $C_8$ will then discharge through $D_{10}$ to B+ and $Q_9$ will shut off. $C_9$ will discharge through $D_{11}$ and $R_{28}$. The entire circuit is now ready fo the next cycle.

Several things should be noted at this point. The reset button 96 is connected across $Q_{13}$. It may be removed from this point and added to the junction of $R_{27}$ and diode $D_{12}$ as shown in phantom in FIG. 1 if it is to be held out after the control circuit has been turned on. $Q_9$ being turned on will automatically override the "reset" button. Secondly, this switching circuit can be used to replace the time delay module by adding the circuit of FIG. 12 to the junction of $R_{25}$ and $R_{26}$. Further, however, resistors $R_{34}$, $R_{35}$ and the triac would have to be replaced. The circuit of FIG. 12 acts with the second ball circuit of the time delay module 76 to instantly force CR-2 to close on contact of the second ball thrown by the bowler which comes into contact with the cushion 32.

Figure 11:
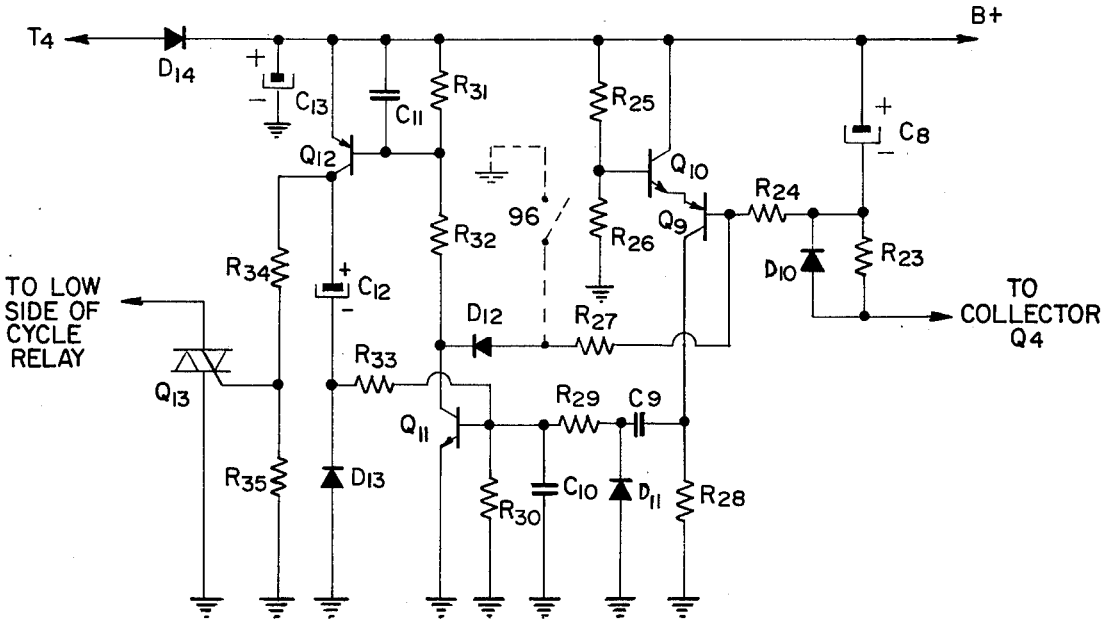
FIG. 11 is a schematic diagram of a circuit used in the modification of Brunswick pinsetter which are not provided with a time delay module.

As shown in FIG. 11, there is provided a diode $D_{14}$ and capacitor $C_{13}$ which are provided because the B+ supply of the mechanical pinsetters were not filtered and this combination accomplishes that purpose.

It will be seen from the aforegoing description that the objects of the present invention in particular of positively activating the proper time delay means to cycle the automatic pinsetter have been achieved through the positioning of the micro-switch and its cooperation with the described circuitry. The invention as described accomplishes its objectives with a minimum of alteration of the prior art Brunswick pinsetters.

In accordance with the patent statutes, the invention of the preferred and alternative embodiments have been shown and described in detail, however, it should be understood that the invention herein is not limited thereto or thereby.

We claim:

1. In an automatic pinsetting machine having a liftable cushion coupled through a cushion rod to a time delay means, said cushion adapted to sense the slightest impact of a bowled ball for cycling the pinsetting machine after a specified time delay, the improvement comprising an actuator, adjustably connected to said cushion rod, a micro-switch mounted adjacent said cushion rod, said actuator adapted to move with said cushion rod to close said micro-switch, a control circuit connected to said micro-switch for commencing the action of the time delay means and continuing the operation thereof after said micro-switch receives an initial closing force, and a switching circuit in communication with said control circuit and said time delay means for activating said time delay means to commence the cycling of the pinsetter.

2. In an automatic pinsetting machine according to claim 1 wherein the time delay means comprises an electric circuit having therein a 3 second RC time constant circuit which commences operation when the switching circuit selectively places a B+ potential at one terminal thereon.

3. An automatic pinsetting machine according to claim 2 wherein said control circuit comprises a monostable multivibrator which is triggered with the closing of said micro-switch and the switching circuit simultaneously places the B+ potential at one terminal at the time delay means.

4. In an automatic pinsetting machine according to claim 3 wherein once the closing of the micro-switch occurs the intermittent vibration of a bowling ball against said liftable cushion will not interrupt the duration of the three second time delays.

5. In an automatic pinsetting machine according to claim 4 wherein said actuator is bent at an angle with respect to the cushion rod to maintain the pessure against a button to maintain the contacts in a normally open position until said cushion rod is moved when said ball impacts against said cushion to cause said actuator to lift only slightly from said button.

6. In an automatic pinsetting machine according to claim 1 said time delay means comprises an electronic circuit for providing the three second time delay and having a switching circuit therein.

7. In an automatic pinsetting machine according to claim 2 wherein the pinsetter is provided with a reset button in order to cycle the machine in the event of malfunction, a hold-out circuit connectable between the said control circuit and said time delay circuit and having a switch therein which acts to override said reset button.

* * * * *